US009559399B2

(12) United States Patent
Yatabe

(10) Patent No.: US 9,559,399 B2
(45) Date of Patent: Jan. 31, 2017

(54) DIELECTRIC WAVEGUIDE INPUT/OUTPUT STRUCTURE AND DIELECTRIC WAVEGUIDE DUPLEXER USING THE SAME

(71) Applicant: TOKO, INC., Tsurugashima-shi (JP)

(72) Inventor: Yukikazu Yatabe, Wako (JP)

(73) Assignee: TOKO, INC., Saitama (JP)

( * ) Notice: Subject to any disclaimer, the term of this patent is extended or adjusted under 35 U.S.C. 154(b) by 101 days.

(21) Appl. No.: 14/485,383

(22) Filed: Sep. 12, 2014

(65) Prior Publication Data

US 2015/0077196 A1 Mar. 19, 2015

(30) Foreign Application Priority Data

Sep. 13, 2013 (JP) ..... 2013-189934

(51) Int. Cl.
*H01P 1/213* (2006.01)
*H01P 1/20* (2006.01)
*H01P 1/208* (2006.01)

(52) U.S. Cl.
CPC ..... *H01P 1/213* (2013.01); *H01P 1/2002* (2013.01); *H01P 1/2138* (2013.01); *H01P 1/2084* (2013.01); *H01P 1/2088* (2013.01)

(58) Field of Classification Search
CPC ..... H01P 1/2002; H01P 1/2138; H01P 7/00; H01P 7/10; H01P 1/213; H01P 1/2131; H01P 1/2084; H01P 1/2088
USPC ..... 333/126, 135, 202, 208, 212, 219.1
See application file for complete search history.

(56) References Cited

U.S. PATENT DOCUMENTS 4,450,421 A * 5/1984 Meguro ..... H01P 1/2056 333/202
4,725,793 A * 2/1988 Igarashi ..... H01P 5/107 333/208
6,002,307 A * 12/1999 Arakawa ..... H01P 1/2088 333/135
6,008,707 A * 12/1999 Tada ..... H01P 1/2136 333/134
6,160,463 A * 12/2000 Arakawa ..... H01P 1/2056 333/202
7,403,085 B2 * 7/2008 Fukunaga ..... H01P 5/10 333/127

(Continued)

FOREIGN PATENT DOCUMENTS

JP 2012-147286 8/2012

*Primary Examiner* — Stephen E Jones
*Assistant Examiner* — Rakesh Patel
(74) *Attorney, Agent, or Firm* — Cozen O'Connor

(57) ABSTRACT

The present invention provides a dielectric waveguide input/output structure for connecting to a coaxial connector a plurality of dielectric waveguide resonators each comprising an approximately parallelepiped-shaped dielectric block, wherein the plurality of dielectric waveguide resonators include a first dielectric waveguide resonator and a second dielectric waveguide resonator each having an exterior coated with an electrically conductive film, except for a coupling window, wherein each of the coupling window is formed with a probe composed of an electrically conductive film, the probe having one end connected to a feeding point, and the other end connected to the electrically conductive film, and wherein the first dielectric waveguide resonator and the second dielectric waveguide resonator are arranged in such a manner that the one side surfaces thereof are located in opposed relation to each other.

8 Claims, 7 Drawing Sheets

(56) References Cited

U.S. PATENT DOCUMENTS

| | | | | |
|---|---|---|---|---|
| 2002/0039058 | A1* | 4/2002 | Sano | H01P 1/207 333/202 |
| 2005/0128031 | A1* | 6/2005 | Wilber | H01P 1/2082 333/202 |
| 2012/0206213 | A1 | 8/2012 | Kojima et al. | |

* cited by examiner

11
ANT
70
Rx
Tx
11a
11b
20a
20b
21a
21b
22a
22b
23a
23b
30a
30b
31a
31b
32a
32b
40a
50
60
x
y
z

PRIOR ART

DIELECTRIC WAVEGUIDE INPUT/OUTPUT STRUCTURE AND DIELECTRIC WAVEGUIDE DUPLEXER USING THE SAME

CROSS-REFERENCE TO RELATED APPLICATION

The present application claims the benefit of priority based on Japanese Patent Application No. 2013-189934 filed on Sep. 13, 2013, the contents of which are incorporated herein by reference.

BACKGROUND OF THE INVENTION

Field of the Invention

The present invention relates to an input/output structure for connecting an antenna to a dielectric waveguide, and, in particular, to a duplexer used for separating a transmission channel from a reception channel.

Description of the Related Art

There has been a dielectric waveguide duplexer comprising a plurality of dielectric waveguide resonators connected to each other via a coupling window, whereby a resonator group for transmission is combined with a resonator group for reception, in order to transmit and receive only a signal in a desired frequency band via an antenna. Generally, the duplexer is required to comprise an input/output structure having a frequency characteristic of larger bandwidth in order to cover different transmission frequency band and reception frequency band.

FIG. 8 is an exploded perspective view, as fluoroscopically viewed from a lower side, of a conventional dielectric waveguide duplexer comprising an input/output structure of a dielectric waveguide described in JP 2012-147286A.

As illustrated in FIG. 8, a dielectric waveguide duplexer 90 comprises a dielectric waveguide 91*a*, dielectric waveguide resonators 91*b*, 91*c*, 91*d*, 91*e*, 91*f*, and a printed circuit board 99.

Each of the dielectric waveguide 91*a* and the dielectric waveguide resonators 91*b*, 91*c*, 91*d*, 91*e*, 91*f* has an exterior coated with an electrically conductive film 94. The dielectric waveguide resonators 91*b* and 91*c* are serially connected to each other via a coupling window 92*b* exposing a dielectric body, and the dielectric waveguide resonators 91*d*, 91*e* and 91*f* are serially connected to each other via coupling windows 92*d* and 92*e* exposing a dielectric body.

The dielectric waveguide 91*a* and the dielectric waveguide resonator 91*b* are connected to each other via a coupling window 92*a* exposing a dielectric body.

The dielectric waveguide 91*a* and the dielectric waveguide resonator 91*d* are connected to each other via a coupling window 92*c* exposing a dielectric body.

The dielectric waveguide 91*a* has a bottom surface provided with an approximately circular island-shaped electrode 93 that is connected in part to the electrically conductive film 94.

The printed circuit board 99 has a main surface provided with a ground pattern 96 and an approximately circular input/output electrode 95 insulated from the ground pattern 96, and has a rear surface provided with a microstrip line 97. One end of the microstrip line 97 is connected to the center of the input/output electrode 95 via a through-hole 98, and the other end is connected to an antenna or the like via a coaxial connector which is not illustrated.

The dielectric waveguide duplexer 90 is disposed in such a manner that the electrically conductive film 94 and the island-shaped electrode 93 are located in opposed relation to the ground pattern 96 and the input/output electrode 95 of the printed circuit board 99, respectively.

The above described dielectric waveguide duplexer 90 is configured to have a frequency characteristic of larger bandwidth by connecting in part the island-shaped electrode 93 to the electrically conductive film 94 so as to have a C-shaped exposed dielectric portion.

BRIEF SUMMARY OF THE INVENTION

Problem to be Solved by the Invention

The above described dielectric waveguide duplexer has the following problems:

it comprises a structure for conversion between the dielectric waveguide and the microstrip, so that an area occupied by the microstrip line cannot be reduced because the microstrip line is required to have a certain level of length;

it may be required to have a metal case cover on the microstrip line for measures against leakage of electromagnetic field caused by an irradiation from the microstrip line;

an unwanted emission or a loss caused by concentration of electric field between the dielectric waveguide resonator and the printed circuit board cannot be avoided in the structure for conversion between the dielectric waveguide and the microstrip due to its structural reason; and it is required to have a dielectric waveguide for input/output separately from a resonator group for connecting dielectric waveguide resonator groups to each other.

The present invention has been made in view of the above problems, and the object thereof is to provide a dielectric waveguide input/output structure designed to have an input/output structure with respect to a coaxial line and a small occupied area, and to be small in volume, inexpensive and small-sized.

Means for Solving the Problem

According to the present invention, there is provided a dielectric waveguide input/output structure for connecting to a coaxial connector a plurality of dielectric waveguide resonators each comprising an approximately parallelepiped-shaped dielectric block, wherein the plurality of dielectric waveguide resonators include a first dielectric waveguide resonator and a second dielectric waveguide resonator each having an exterior coated with an electrically conductive film, except for a coupling window provided in one side surface of the parallelepiped-shaped dielectric blocks of the first and second dielectric waveguide resonators, wherein each of the coupling window is formed with a linear-shaped probe composed of an electrically conductive film, the probe having one end connected to a feeding point which is formed on an edge of the one side surface and insulated from the electrically conductive film, and the other end connected to a portion of the electrically conductive film around an outer periphery of the coupling window, and wherein the first dielectric waveguide resonator and the second dielectric waveguide resonator are arranged in such a manner that the one side surfaces thereof are located in opposed relation to each other to allow the coupling windows thereof to be positionally aligned with each other.

Effect of the Invention

In the dielectric waveguide input/output structure of the present invention, it is not required to convert a coaxial line into a microstrip line. This makes it possible to provide a dielectric waveguide input/output structure which is not required to have measures against leakage of electromagnetic field, and a dielectric waveguide duplexer comprising the input/output structure. Further, it is not required to have any excess dielectric waveguides. This makes it possible to reduce the number of components of the dielectric waveguide duplexer, to thereby have a reduced occupation area and volume, and to provide a dielectric waveguide input/output structure which may be inexpensive and small-sized dielectric duplexer, and a dielectric waveguide duplexer comprising this input/output structure.

DETAILED DESCRIPTION OF THE INVENTION (Embodiment of Input/Output Structure)

Figure 1:
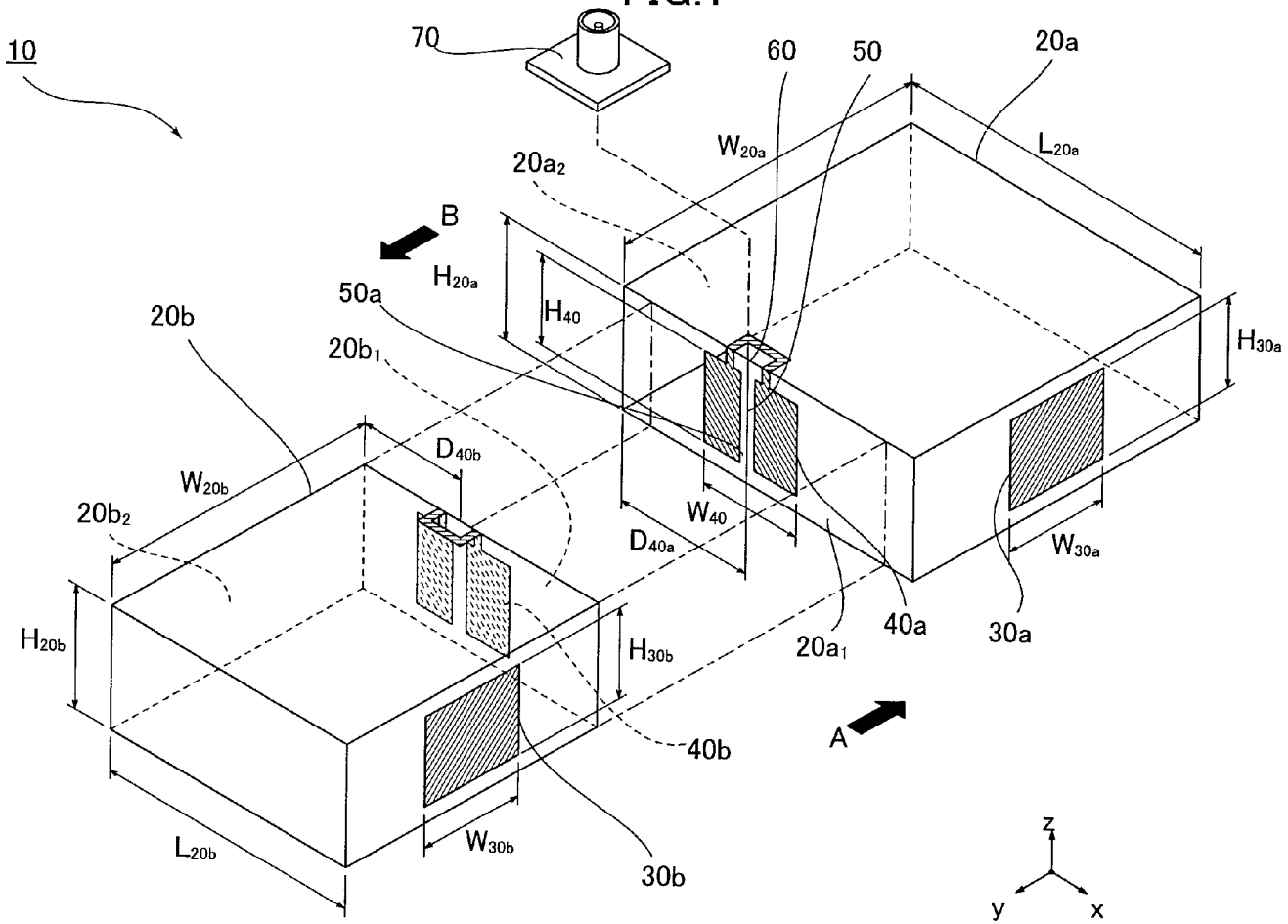
FIG. 1 is an exploded perspective view for explaining a dielectric waveguide input/output structure according to the present invention.
Figure 2:
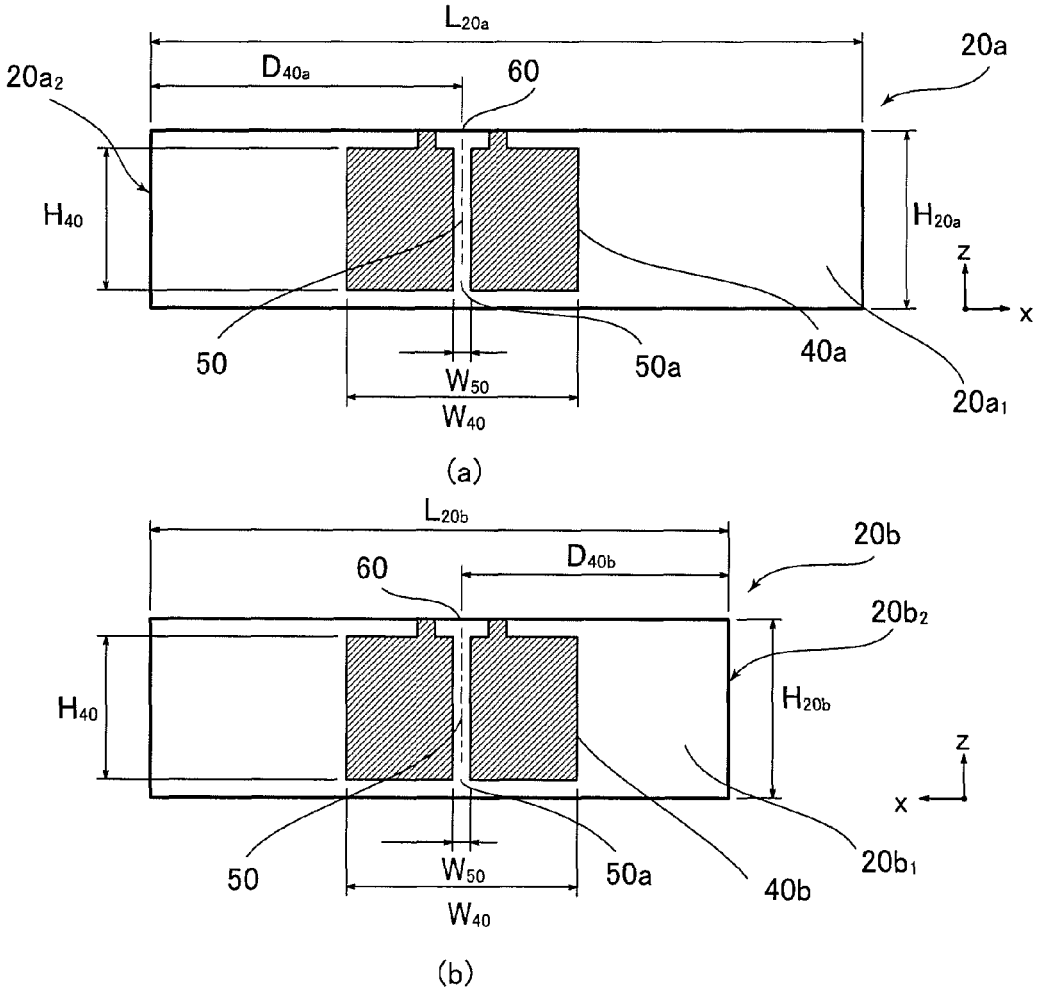
FIGS. 2A and 2B are illustrations for explaining in detail the dielectric waveguide input/output structure according to the present invention.
Figure 3:
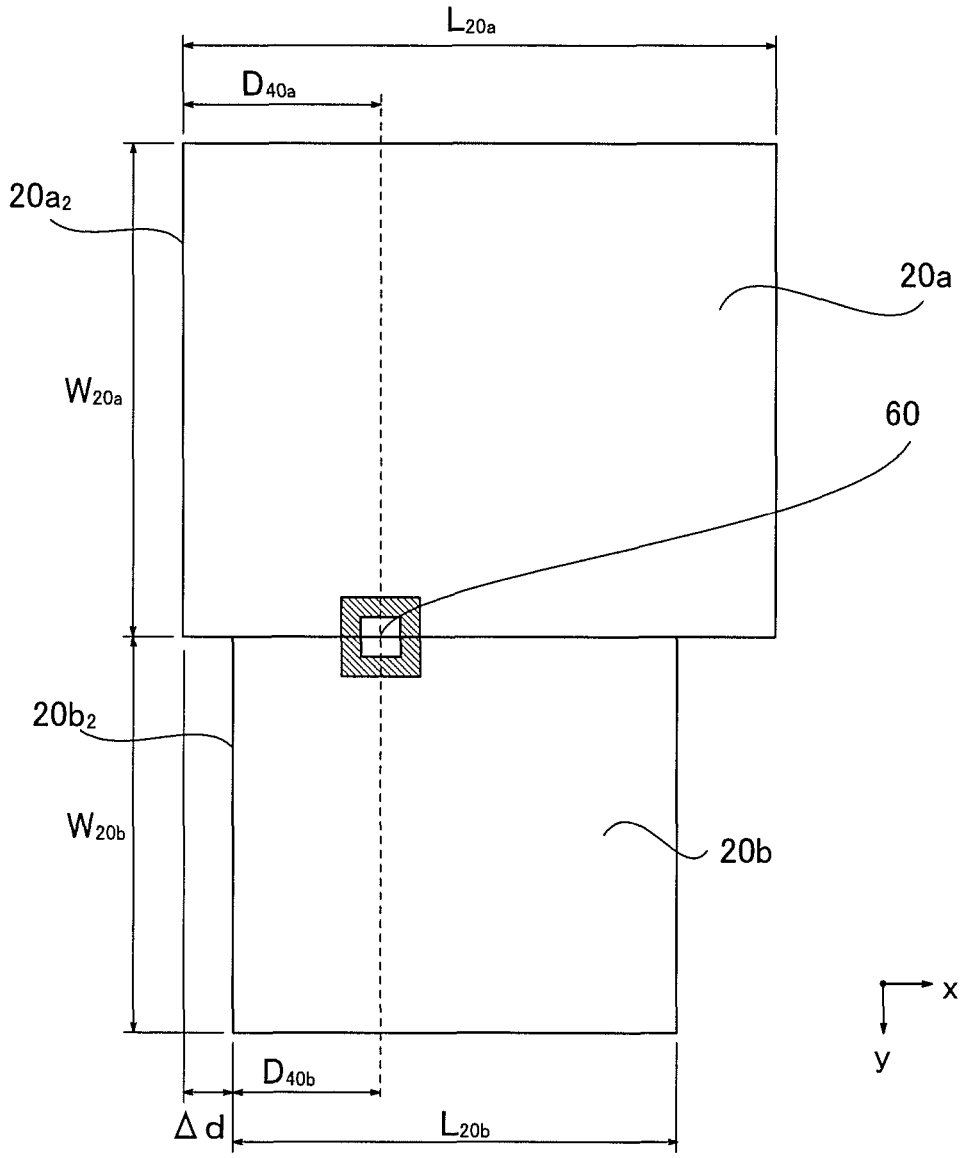
FIG. 3 is a plain view for explaining the dielectric waveguide input/output structure according to the present invention.

A dielectric waveguide input/output structure of the present invention will now be described with reference to FIGS. 1 to 3. FIG. 1 is an exploded perspective view, as viewed fluoroscopically, for explaining a dielectric waveguide input/output structure according to the present invention, FIG. 2A is a front view of a side surface $\mathbf{20}a_1$ of a dielectric waveguide resonator 20*a*, as viewed from a direction indicated by an arrow A in FIG. 1, FIG. 2B is a front view of a side surface $\mathbf{20}b_1$ of a dielectric waveguide resonator 20*b*, as viewed from a direction indicated by an arrow B in FIG. 1, and FIG. 3 is a plain view of the dielectric waveguide input/output structure. In FIGS. 1 to 3, the shaded area represents an exposed dielectric portion.

As illustrated in FIGS. 1 to 3, a dielectric waveguide input/output structure 10 of the present invention comprises:

a dielectric waveguide resonator 20*a* on a lower frequency side, obtained by coating, with an electrically conductive film, an exterior of an approximately rectangular parallelepiped-shaped dielectric body having a length $L_{20a}$, width $W_{20a}$ and thickness $H_{20a}$;

a dielectric waveguide resonator 20*b* on a higher frequency side, obtained by coating, with an electrically conductive film, an exterior of an approximately rectangular parallelepiped-shaped dielectric body having a length $L_{20b}$, width $W_{20b}$ and thickness $H_{20b}$; and a coaxial connector 70.

One side surface $\mathbf{20}a_1$ of the dielectric waveguide resonator 20*a* and one side surface $\mathbf{20}b_1$ of the dielectric waveguide resonator 20*b* are provided with coupling windows 40*a* and 40*b* having a width $W_{40}$ and height $H_{40}$ and exposing the dielectric body respectively, and the dielectric waveguide resonators are arranged in such a manner that the side surfaces $\mathbf{20}a_1$ and $\mathbf{20}b_1$ are located in opposed relation to each other to allow the coupling windows 40*a* and 40*b* to be positionally aligned with each other.

Each of the coupling windows 40*a* and 40*b* comprises a linear-shaped probe 50 composed of an electrically conductive film. The probe 50 has one end connected to a feeding point 60 which is provided on an edge of each of the side surfaces $\mathbf{20}a_1$ and $\mathbf{20}b_1$ and insulated from the electrically conductive film, and the other end connected to an electrically conductive film on an outer periphery of each of the coupling windows 40*a* and 40*b*. The coaxial connector 70 is disposed on the feeding point 60.

The coupling window 40*a* is located away from a side surface $\mathbf{20}a_2$ positioned on the left side of the side surface $\mathbf{20}a_1$ by a distance $D_{40a}$, and the coupling window 40*b* is located away from a side surface $\mathbf{20}b_2$ positioned on the right side of the side surface $\mathbf{20}b_1$ by a distance $D_{40b}$. That is, the dielectric waveguide resonators 20*a* and 20*b* are arranged to allow the side surfaces $\mathbf{20}a_2$ and $\mathbf{20}b_2$ to be displaced from each other by $\Delta d$ ($=D_{40a}-D_{40b}$).

Figure 4:
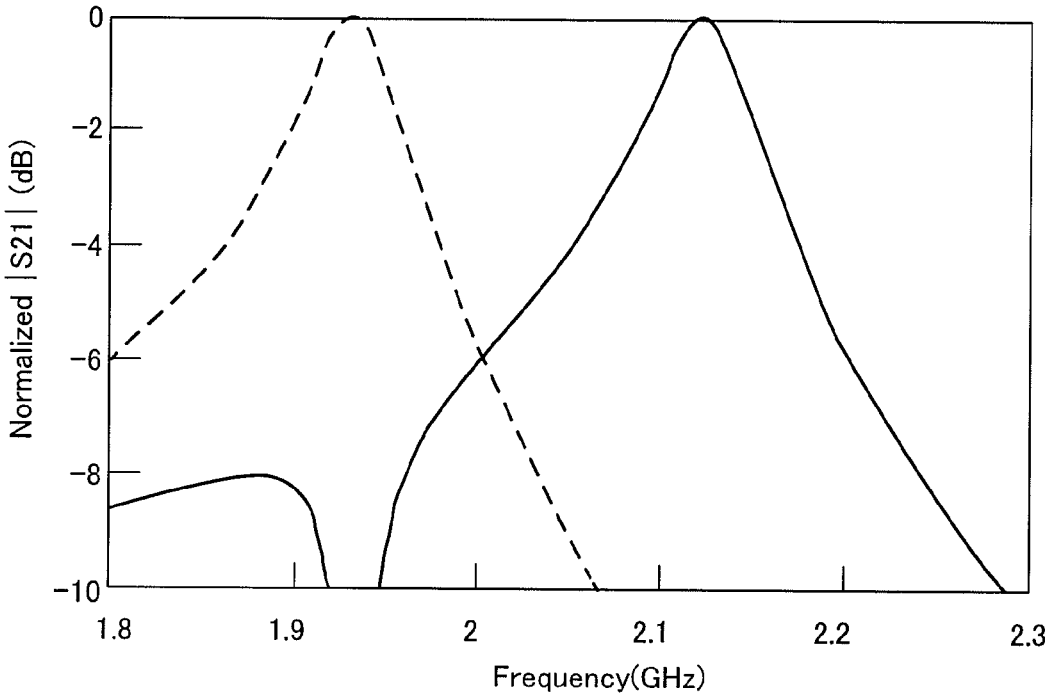
FIG. 4 is a graph illustrating a normalized frequency characteristic of the dielectric waveguide input/output structure according to the present invention.

FIG. 4 is a graph illustrating a normalized frequency characteristic of the above described dielectric waveguide input/output structure. In FIG. 4, the dashed line represents a characteristic on the lower frequency side, and the solid line represents a characteristic on the higher frequency side, wherein the horizontal axis represents dB, and the vertical axis represents a frequency GHz.

In the above described embodiment, an external Q is adjustable by the distances $D_{40a}$ and $D_{40b}$.

The external Q has an optimal value determined by each bandwidth of a transmission channel side and a reception channel side, and is generally adjusted by a width of the coupling windows or the like. In the dielectric waveguide input/output structure of the present invention, the external Q is adjustable not only by the width of the coupling windows, but also by arranging the coupling windows to be displaced from the center of width direction (direction of x-axis in the figure) of the side surfaces $\mathbf{20}a_1$ and $\mathbf{20}b_1$.

The external Q may become smallest when the coupling windows 40*a* and 40*b* are arranged at the center of width direction of the side surfaces $\mathbf{20}_{a1}$ and $\mathbf{20}_{b1}$ respectively. However, the length $L_{20a}$ of the dielectric waveguide resonator 20*a* is different from the length $L_{20b}$ of the dielectric waveguide resonator 20*b* because the dielectric waveguide resonators 20*a* and 20*b* are different from each other in terms of their frequency bands. For this reason, when the coupling windows are arranged in respective side surfaces, the side surface $\mathbf{20}a_2$ does not necessarily become coplanar with the side surface $\mathbf{20}b_2$. The dielectric waveguide resonators 20*a* and 20*b* must be arranged to allow the coupling windows 40*a* and 40*b* to be overlapped with each other, so that the positional alignment thereof becomes difficult.

Then, it is also possible to arrange the coupling window 40*a* and/or the coupling window 40*b* in such a manner as to allow $D_{40a}$ and $D_{40b}$ to be the same (namely, $\Delta$ to be 0), to thereby facilitate the positional alignment at the time of assembly.

The above described dielectric waveguide input/output structure does not comprise any dielectric waveguide for input/output separately from the resonator groups, and is comprised only of the resonator groups. This makes it possible to reduce the number of components of the dielectric waveguide duplexer, thereby to reduce the occupation area and the volume and to achieve an inexpensive dielectric duplexer. It is noted that the frequency characteristic of larger bandwidth cannot be obtained unless the other end of the probe is connected to the electrically conductive film on the outer periphery of the coupling window, so that such an unconnected structure is not suitable as an input/output structure of a duplexer.

(Embodiment of Duplexer)

Figure 5:
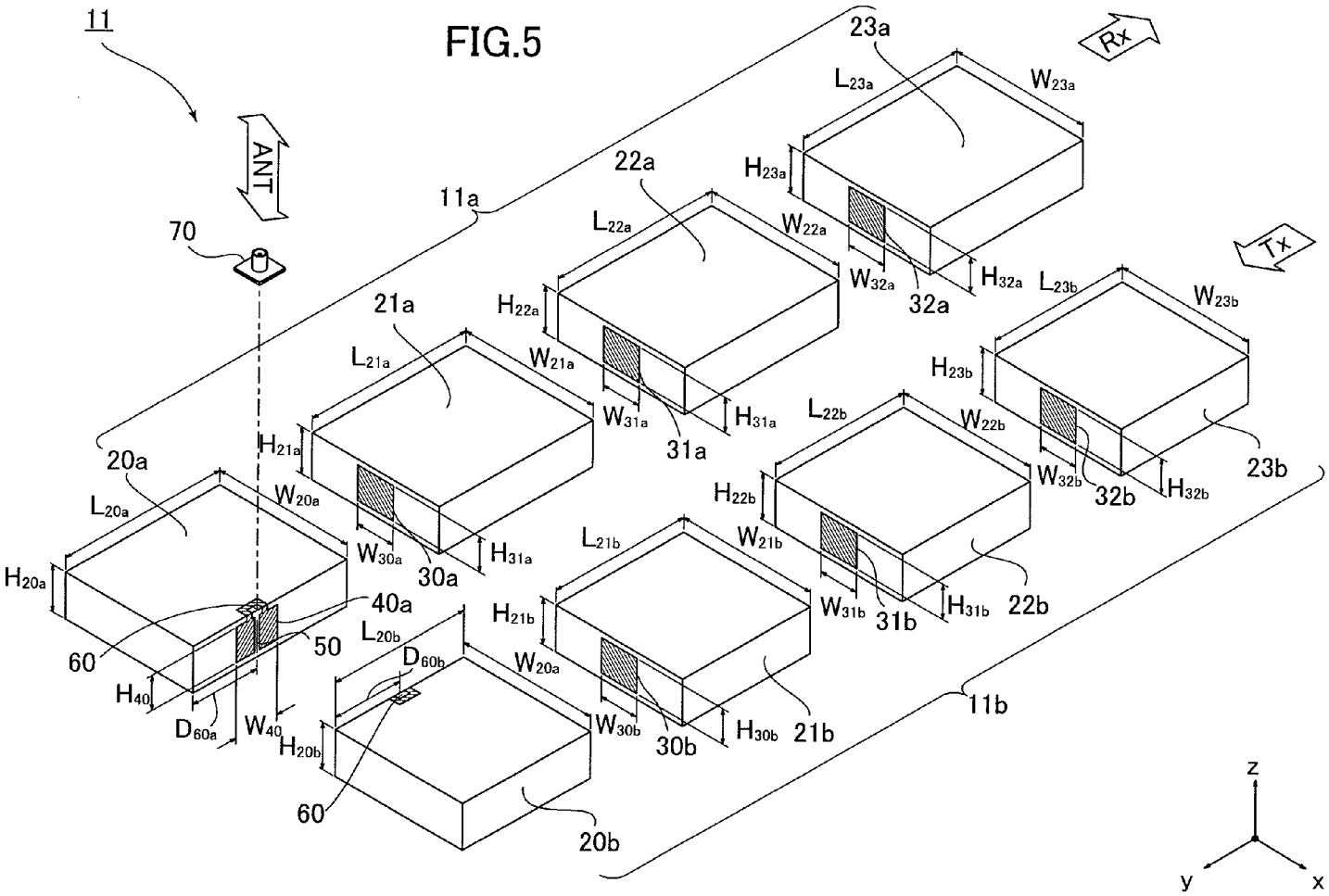
FIG. 5 is an exploded perspective view for explaining a dielectric waveguide duplexer according to the present invention.

FIG. 5 is a perspective view, as viewed from an upper side, of an embodiment of a dielectric waveguide duplexer comprising the dielectric waveguide input/output structure illustrated in FIG. 1. In FIG. 5, the shaded area represents an exposed dielectric portion. Like numerals refer to the same components as in the dielectric waveguide input/output structure illustrated in FIGS. 1 to 3 and any description thereof will be omitted.

As illustrated in FIG. 5, a dielectric waveguide duplexer 11 comprises a resonator group 11*a* for reception on the lower frequency side, a resonator group 11*b* for transmission on the higher frequency side, and a coaxial connector 70.

The resonator group 11*a* comprises dielectric resonators 20*a*, 21*a*, 22*a* and 23*a* serially connected via coupling windows 30*a*, 31*a* and 32*a*.

The resonator group 11*b* comprises dielectric resonators 20*b*, 21*b*, 22*b* and 23*b* serially connected via coupling windows 30*b*, 31*b* and 32*b*.

One side surface $\mathbf{20}a_1$ of the dielectric waveguide resonator 20*a* and one side surface $\mathbf{20}b_1$ of the dielectric waveguide resonator 20*b* are provided with coupling windows 40*a* and 40*b* respectively, and the dielectric waveguide resonators are arranged in such a manner that the side surfaces $\mathbf{20}a_1$ and $\mathbf{20}b_1$ are located in opposed relation to each other to allow the coupling windows 40*a* and 40*b* to be positionally aligned with each other.

The coaxial connector 70 is connected to an antenna which is not illustrated.

The above described dielectric waveguide duplexer 11 is capable of filtering a received signal Rx on the lower frequency side received from the antenna by the resonator group 11*a*, and filtering a transmission signal Tx on the higher frequency side by the resonator group 11*b* and transmit the signal from the antenna ANT.

Figure 6:
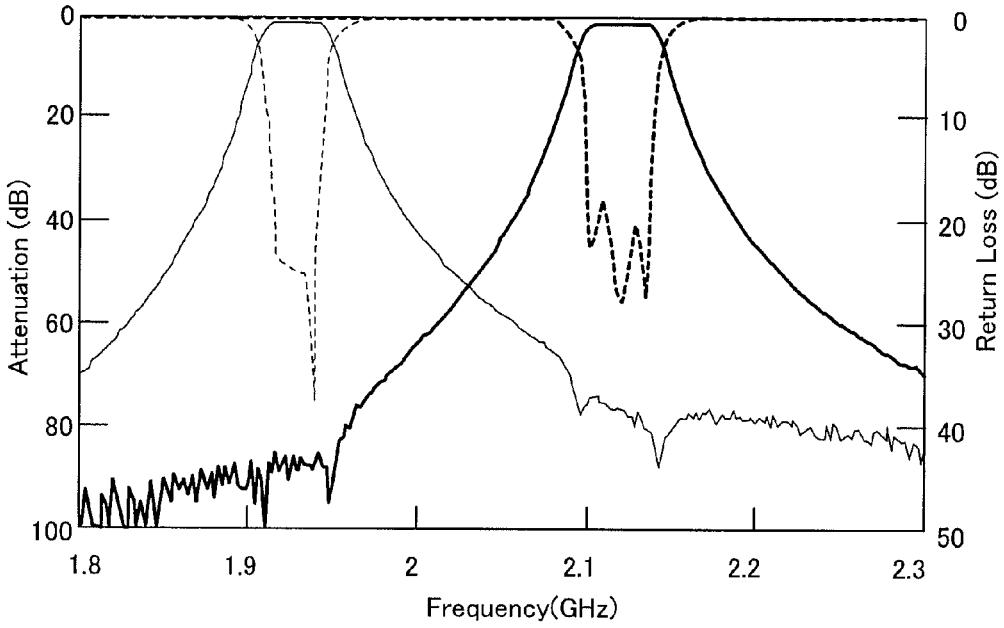
FIG. 6 is a graph illustrating a normalized frequency characteristic of the dielectric waveguide duplexer comprising the dielectric waveguide input/output structure according to the present invention.

FIG. 6 is a graph illustrating a frequency characteristic of the embodiment of the dielectric waveguide duplexer 11 illustrated in FIG. 5. In the figure, the thin line represents a receiving side Rx, and the thick line represents a transmitting side Tx, wherein a return loss is represented by the dashed line, and an insertion loss is represented by the solid line.

The dielectric waveguide duplexer is designed to have the following values:

center frequency of the receiving side: $f\mathbf{0}_a$=1.93 GHz; bandwidth of the receiving side: $W_a$=20 MHz;

center frequency of the transmitting side: $f\mathbf{0}_b$=2.12 GHz; and bandwidth of the transmitting side: $W_b$=20 MHz.

The dielectric resonator 20*a* has a length $L_{20a}$=25.15 mm, a width $W_{20a}$=22 mm, and a height $H_{20a}$=4 mm.

The dielectric resonator 21*a* has a length $L_{21a}$=24.96 mm, a width $W_{21a}$=22 mm, and a height $H_{21a}$=4 mm.

The dielectric resonator 22*a* has a length $L_{22a}$=24.96 mm, a width $W_{22a}$=22 mm, and a height $H_{22a}$=4 mm.

The dielectric resonator 23*a* has a length $L_{23a}$=24.71 mm, a width $W_{23a}$=22 mm, and a height $H_{23a}$=4 mm.

The dielectric resonator 20*b* has a length $L_{20b}$=20.70 mm, a width $W_{20b}$=22 mm, and a height $H_{20b}$=4 mm.

The dielectric resonator 21*b* has a length $L_{21b}$=20.57 mm, a width $W_{21b}$=22 mm, and a height $H_{21b}$=4 mm.

The dielectric resonator 22*b* has a length $L_{22b}$=20.57 mm, a width $W_{22b}$=22 mm, and a height $H_{22b}$=4 mm.

The dielectric resonator 23*b* has a length $L_{23b}$=20.35 mm, a width $W_{23b}$=22 mm, and a height $H_{23b}$=4 mm.

The coupling window 30*a* has a width $W_{30a}$=5.47 mm, and a height $H_{30a}$=3 mm.

The coupling window 31*a* has a width $W_{31a}$=4.67 mm, and a height $H_{31a}$=3 mm.

The coupling window 32*a* has a width $W_{32a}$=5.47 mm, and a height $H_{32a}$=3 mm.

The coupling window 30*b* has a width $W_{30b}$=4.51 mm, and a height $H_{30b}$=3 mm.

The coupling window 31*b* has a width $W_{31b}$=3.96 mm, and a height $H_{31b}$=3 mm.

The coupling window 32*b* has a width $W_{32b}$=4.51 mm, and a height $H_{32b}$=3 mm.

The coupling window 40 has a width $W_{40}$=7.60 mm, and a height $H_{40}$=3.6 mm.

The position of the coupling window 40 is: $D_{40a}$=6.45 mm, and $D_{40b}$=6.45 mm.

The width of the probe 50 is: $W_{50}$=1.1 mm.

The relative permittivity of the dielectric resonators 20*a* to 23*a* and 20*b* to 23*b* is 21.

FIG. 6 shows that a characteristic of narrow bandwidth and isolation between the transmission frequency Tx and the reception frequency Rx are obtained.

Alternative Embodiment

Figure 7:
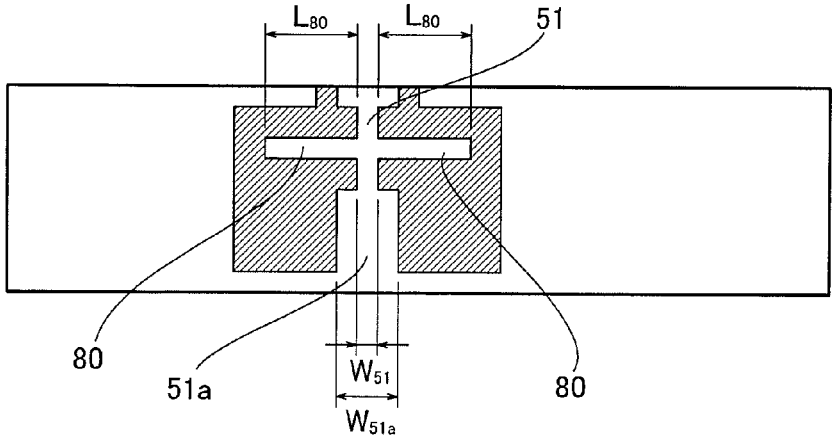
FIG. 7 is an illustration for explaining an alternative embodiment of the dielectric waveguide input/output structure according to the present invention.
Figure 8:
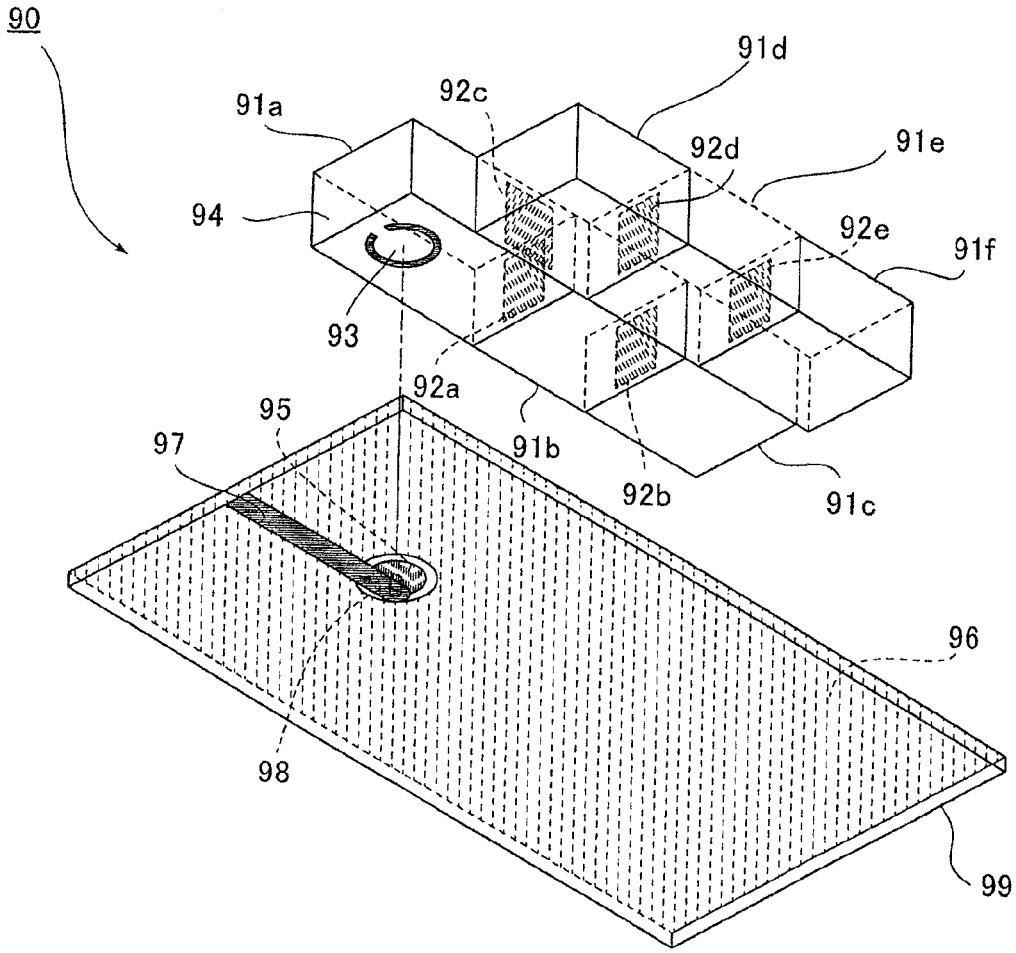
FIG. 8 is an exploded perspective view of an example of a conventional dielectric waveguide duplexer.

FIG. 7 is an illustration of a coupling window for explaining an alternative embodiment of the present invention.

As illustrated in FIG. 7, by allowing a distal end 51*a* of a probe 51 to have a width $W_{51a}$ that is larger than the probe width $W_{51}$ ($W_{51a}>W_{51}$), it becomes possible to achieve an impedance matching and reduce the external Q. Further, as illustrated in FIG. 7, it is also possible to provide a stub 80 having a length $L_{80}$ on opposite sides of the probe 51, to thereby suppress the third harmonic. Preferably, $L_{80}$ is the ¼ of a guide wavelength λ.

The probe 51 and the stub 80 may be provided in both or either one of the coupling windows 40*a* and 40*b*. Alternatively, it is also possible to provide the probe 51 in the coupling window 40*a* and provide the stub 80 in the coupling window 40*b*, so as to have a combined desired shape when the dielectric waveguide resonators 20*a* and 20*b* are arranged in opposed relation with each other.

Further, in the above embodiment, the coaxial connector is directly disposed on the dielectric waveguide resonator. Alternatively, the coaxial connector may also be disposed by interposing a printed circuit board which is slightly larger than the occupation area of the coaxial connector in order to ensure the connection strength of the coaxial connector.

EXPLANATION OF CODES

10: dielectric waveguide input/output structure

11, 90: dielectric waveguide duplexer

11*a*, 11*b*: resonator group

20*a*, 21*a*, 22*a*, 23*a*, 20*b*, 21*b*, 22*b*, 23*b*, 91*b*, 91*c*, 91*d*, 91*e*, 91*f*: dielectric waveguide resonator

30*a*, 31*a*, 32*a*, 30*b*, 31*b*, 32*b*, 40*a*, 40*b*, 92*a*, 92*b*, 92*c*, 92*d*, 92*e*: coupling window
50, 51: probe
60: feeding point
70: coaxial connector
80: stub
91*a*: dielectric waveguide
93: island-shaped electrode
94: electrically conductive film
95: input/output electrode
96: ground pattern
97: microstrip line
98: through-hole
99: printed circuit board

What is claimed is:

1. A dielectric waveguide input/output structure for connecting to a coaxial connector a plurality of dielectric waveguide resonators each comprising an approximately parallelepiped-shaped dielectric block, wherein the plurality of dielectric waveguide resonators include a first dielectric waveguide resonator and a second dielectric waveguide resonator each having an exterior surface coated with an electrically conductive film, except for one side surface in which a coupling window is provided, wherein a linear-shaped probe composed of the electrically conductive film is formed in the coupling window, the probe having two ends, one of the two ends is connected to a feeding point which is formed on an edge of the one side surface and insulated from the electrically conductive film, and the other of the two ends is connected to a portion of the electrically conductive film around an outer periphery of the coupling window, wherein the first dielectric waveguide resonator and the second dielectric waveguide resonator are arranged in such a manner that the one side surfaces thereof are facing to contact each other to allow the coupling windows thereof to be aligned with each other, and wherein the coaxial connector is mounted on the feeding point.

2. The dielectric waveguide input/output structure as defined in claim 1, wherein the probe is provided with a stub.

3. The dielectric waveguide input/output structure as defined in claim 2, wherein a part of the probe is provided in the coupling window of the first dielectric waveguide resonator, and the rest of the probe is provided in the coupling window of the second dielectric waveguide resonator, so as to have a combined desired shape when the dielectric waveguide resonators are arranged in facing relation with each other.

4. The dielectric waveguide input/output structure as defined in any one of claims 1 to 3, wherein the one side surface of the first dielectric waveguide resonator and the one side surface of the second dielectric waveguide resonator are different in terms of a lateral length.

5. The dielectric waveguide input/output structure as defined in claim 4, wherein the coupling window of the first dielectric waveguide resonator is displaced from a center of the one side surface of the first dielectric waveguide resonator in such a manner as to allow an other side surface of the first dielectric waveguide resonator adjacent to the one side surface of the first dielectric waveguide resonator to be coplanar with an other side surface of the second dielectric waveguide resonator adjacent to the one side surface of the second dielectric waveguide resonator and on the same side as the other side surface of the first dielectric waveguide resonator.

6. The dielectric waveguide input/output structure as defined in claim 4, wherein the coupling window of the second dielectric waveguide resonator is displaced from a center of the one side surface of the second dielectric waveguide resonator in such a manner as to allow an other side surface of the first dielectric waveguide resonator adjacent to the one side surface of the first dielectric waveguide resonator to be coplanar with an other side surface of the second dielectric waveguide resonator adjacent to the one side surface of the second dielectric waveguide resonator and on the same side as the other side surface of the first dielectric waveguide resonator.

7. The dielectric waveguide input/output structure as defined in claim 4, wherein the coupling window of the first dielectric waveguide resonator is displaced from a center of the one side surface of the first dielectric waveguide resonator, and the coupling window of the second dielectric waveguide resonator is displaced from a center of the one side surface of the second dielectric waveguide resonator, in such a manner as to allow an other side surface of the first dielectric waveguide resonator adjacent to the one side surface of the first dielectric waveguide resonator to be coplanar with an other side surface of the second dielectric waveguide resonator adjacent to the one side surface of the second dielectric waveguide resonator and on the same side as the other side surface of the first dielectric waveguide resonator.

8. A dielectric waveguide duplexer comprising the dielectric waveguide input/output structure as defined in claim 1.

* * * * *